United States Patent [19]

Vicenzi

[11] Patent Number: 4,537,189

[45] Date of Patent: Aug. 27, 1985

[54] BREATHING DEVICE

[75] Inventor: Reno L. Vicenzi, Riverside, Calif.

[73] Assignee: Figgie International Inc., Willoughby, Ohio

[21] Appl. No.: 534,792

[22] Filed: Sep. 22, 1983

[51] Int. Cl.[3] ..... A62B 7/00

[52] U.S. Cl. ..... 128/202.13; 128/206.22

[58] Field of Search ..... 128/201.23, 201.26, 128/202.15, 202.16, 202.13, 206.22, 206.28, 206.29, 206.21, 201.27, 201.28, 205.12

[56] References Cited

U.S. PATENT DOCUMENTS

| | | | |
|---|---|---|---|
| 183,521 | 10/1876 | Weck | 128/201.27 |
| 2,005,072 | 6/1935 | Booharin | 128/141 |
| 2,304,798 | 12/1942 | Comstock | 128/142 |
| 2,391,677 | 12/1945 | Bulbulian | 128/142 |
| 2,444,417 | 7/1948 | Bierman | 128/142 |
| 3,473,165 | 10/1969 | Gran et al. | 2/6 |
| 3,550,588 | 12/1970 | Stahl | 128/141 |

*Primary Examiner*—Henry J. Recla

*Attorney, Agent, or Firm*—Christel, Bean & Linihan

[57] ABSTRACT

An effluent receiver 32 associated with a mask 12 of the type provided with a face portion 22 adapted to be spaced away from the face of the wearer to provide a breathing cavity 26 between the wearer's face and mask. Sealing means 24 associated with the face portion 22 provides a seal to prevent the ingress or egress of gases into or out of the breathing cavity 26. The effluent receiver 32 can be readily assembled to the face protion and is normally associated with a one way valve 42 which prevents the backflow of effluents and/or ambient gases from the receiver 32 to the mask. The parts are so designed that the effluent receiver can be readily assembled. The overall design provides protection for the wearer from ambient gases while permitting a controlled elimination of effluents.

12 Claims, 8 Drawing Figures

Fig. 3.
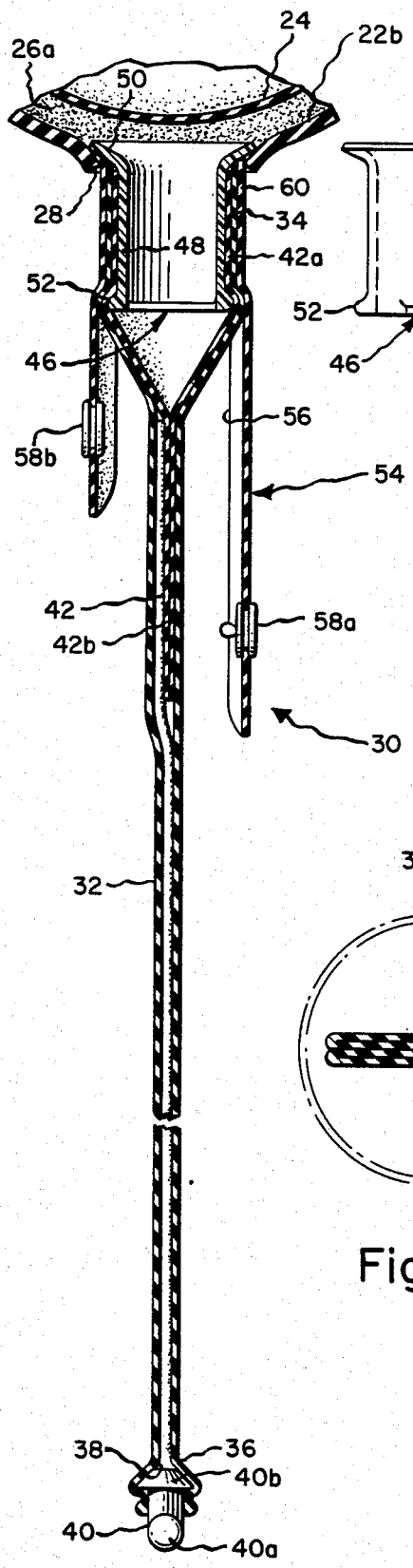
Fig. 4.
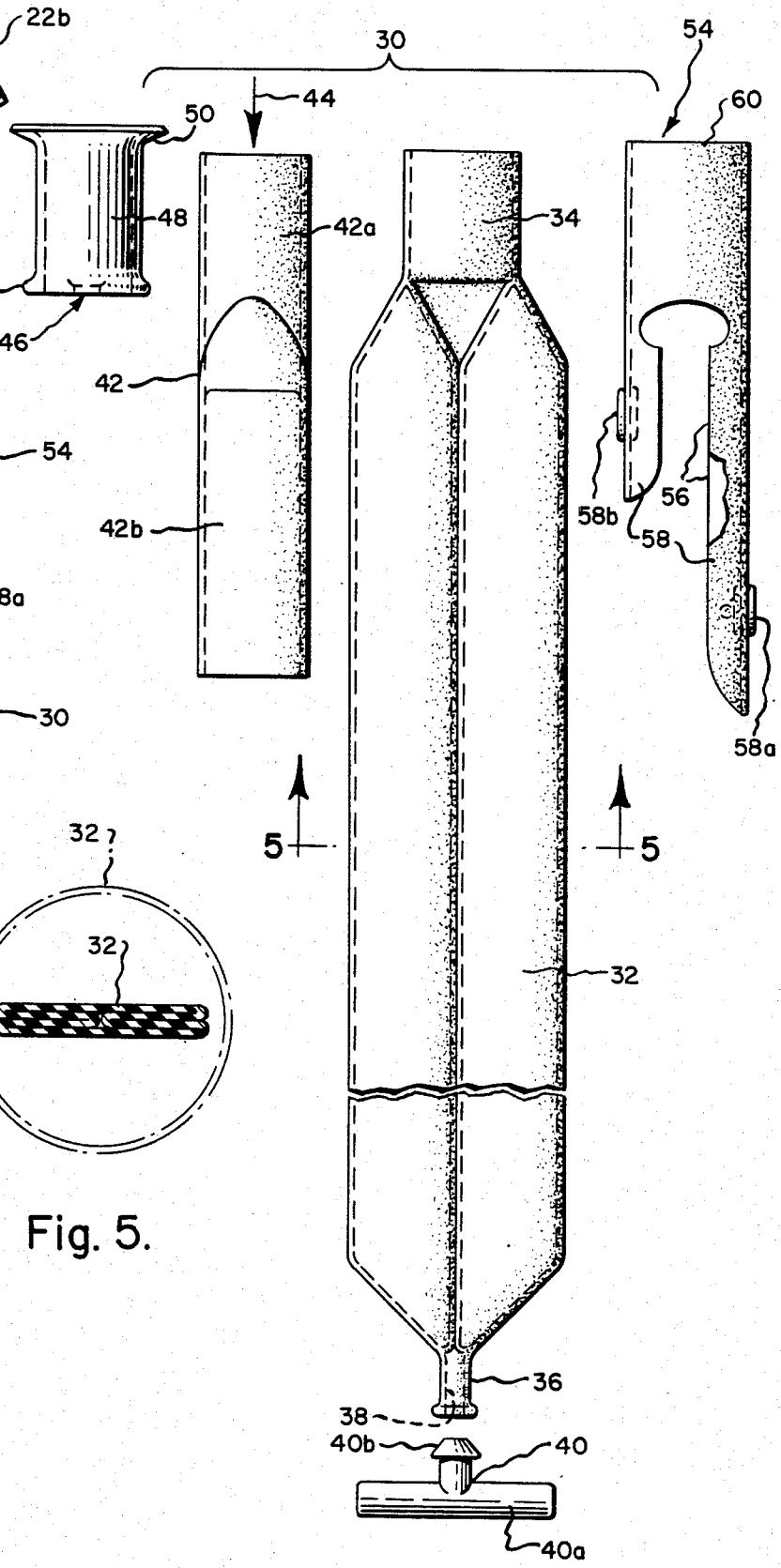
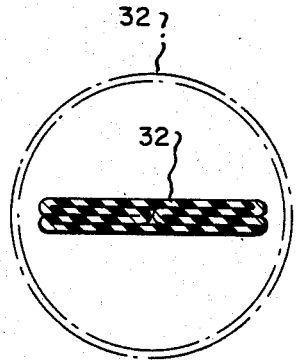
Fig. 5.

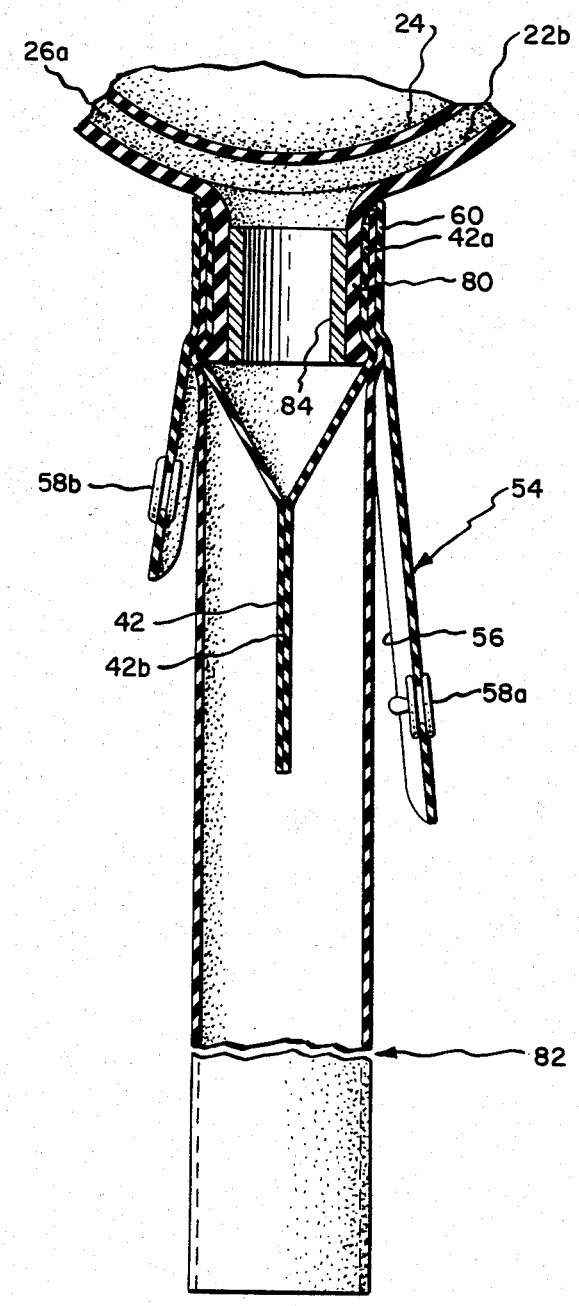
Fig. 8.
Fig. 6.
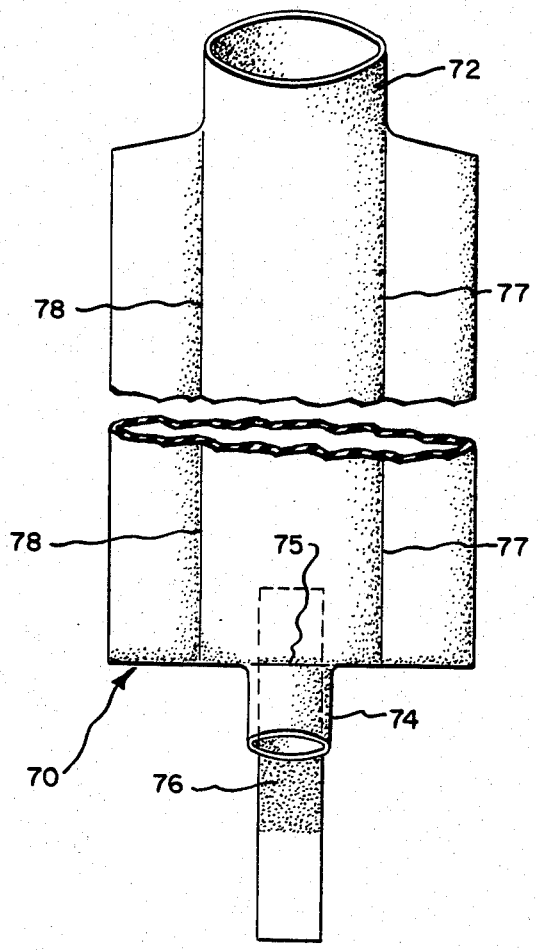
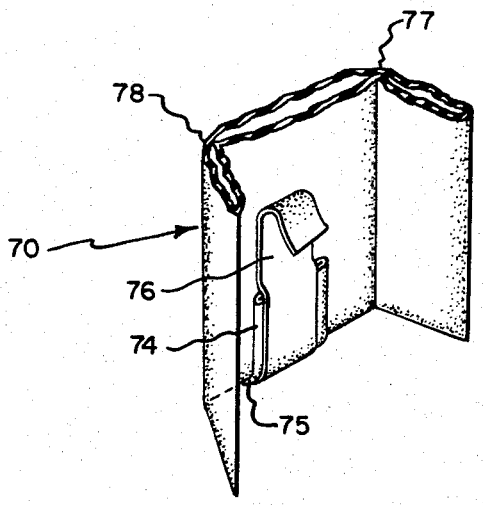
Fig. 7.

BREATHING DEVICE

TECHNICAL FIELD

The present invention relates generally to a breathing device which provides a breathing cavity adjacent the wearer's nose and mouth for the reception of breathing gases. More particularly the present invention relates to a breathing device of the type described which is provided with an effluent receiver capable of receiving the wearer's effluents.

BACKGROUND OF THE INVENTION

For simplicity's purpose the present invention will be described in association with a specific form of breathing device, namely an aviator's mask. However, the principles of this invention can be applied to other breathing devices such as, for example gas masks of the type worn by ground troops during a gas attack.

One of the problems associated with breathing devices of the type referred to is the collection of effluents within the mask. Such effluents can be vomit, sweat, or mucous products. As the mask is customarily sealed about the face of the wearer to prevent either the ingress of ambient gases or the egress of breathing gases, the wearer's effluents will accumulate in the mask. The accumulated effluents could initially cause discomfort to the wearer and may subsequently jeopardize the proper functioning of some of the components of the mask, such as the exhalation valve. In the commonly used aviator's masks or infantry gas masks of today the only practical way such effluents can be discharged is by pulling the mask away from the face, thereby breaking the mask seal, and letting the effluents drain out between the mask and the face. There are several fundamental disadvantages to this practice. Thus, the effluents are free to enter the environment of the wearer, which may be the cockpit of an aircraft, causing subsequent fouling of the wearer's environment as well as the apparel of the wearer. Additionally, breaking the face seal of the mask may compromise the safety of the wearer if the atmosphere external to the mask is not suitable for breathing as would be the case if the atmosphere contained lethal gases, such as nerve gases, or similarly, if the atmosphere contained insufficient oxygen for breathing purposes.

The prior art has recognized some of the problems set forth above. In U.S. Pat. No. 3,473,165 a space suit is disclosed having a venting device associated therewith. This device serves several purposes such as venting or purging the interior of the helmet, for feeding, or for collecting effluents externally in a disposable receiver. Thus, the face mask of a pressure suit is provided with a valve housing provided with a port which can be disposed in various positions depending upon the desired operation. Disposed on the inside of the face mask adjacent the mouth of the wearer is a funnel-like mouthpiece which is in turn secured to the housing, the mouthpiece also being provided with a valve. Finally, for collecting effluents a pouch may be secured to an external portion of the valve housing by a snap ring. While this device does provide for the encapsulation of effluents exterior of the mask for subsequent disposal, it utilizes a relatively expensive and unduly complex valving arrangement which cannot be readily cleaned after use. Also, the particular device is designed primarily for receiving vomit and other effluent products discharged from the mouth and it cannot readily receive mucous from the nasal/oral cavities or sweat. It is also possible that the valve housing can be improperly manipulated by the operator causing the system to be open to the external atmosphere.

Another device is shown in U.S. Pat. No. 2,444,417 which discloses an oxygen mask having an inlet and an outlet. The mask is also provided with a further port and the patent discloses that any condensation formed within the mask will tend to collect in a reservoir formed in the neighborhood of the port. Should the amount of condensation become too great, it could be drained through the port by flexing the port until its recess is so distorted as to provide a connection from the reservoir to the atmosphere. A somewhat similar device is shown in U.S. Pat. No. 2,005,072 which is provided with a pair of one-way valves through which effluents may be discharged. While both of the above two devices are relatively simple, neither one provides an effluent receiver which can be utilized to prevent the soiling of the wearer's apparel and/or environment. Furthermore, in the first of the two devices there is no provision for an entirely closed system which would prevent the ingress of atmospheric air into the breathing cavity.

OBJECTS AND SUMMARY OF THE INVENTION

It is the principal object of the present invention to provide an improved breathing device having an effluent receiver.

More particularly, one of the objects of the present invention is to provide a breathing device having an effluent receiver which effluent receiver prevents the soiling of the wearer's apparel and/or environment and which also prevents the backflow of effluents and/or ambient gases into the mask.

It is an additional object of the present invention to provide a breathing device which gives complete protection from external atmosphere while providing for the disposal of effluent in a receiver external of the breathing device.

It is a further object of the present invention to provide a breathing device having an effluent receiver which can be drained if necessary.

Yet another object is to provide a breathing device having an effluent receiver disposed externally of the device, which effluent receiver can be stored in such a manner as to not obstruct the wearer's vision.

The foregoing objects and other objects and advantages of this invention are accomplished in one modification by providing a breathing device including an effluent receiver which may be removably secured to the face portion of the device. The effluent receiver is in the form of an expandible or elastic bag having a main body portion formed of flexible material impervious to liquids, one end of the effluent receiver receiving one end of a one-way valve, the main portion of which is disposed within the receiver. The ends of the receiver and the one-way valve are secured about a cylindrical portion of a relatively rigid tubular member which extends outwardly from the face mask of the breathing device. The effluent receptacle is so designed that it can be rolled up and held in place on the tubular member by a resilient strap having fasteners at opposed ends.

In another modification the breathing device includes an effluent receiver in the form of an elongated conduit, one end being disposed about a one-way valve and being removably interconnected to the face mask of the breathing device, and the other end being open. This form can also be rolled up.

The objects set forth above as well as other objects and advantages of the present invention will become more apparent after a consideration of the following detailed description taken in conjuntion with the accompanying drawings in which preferred forms of this invention are illustrated.

BRIEF DESCRIPTION OF THE DRAWINGS

FIG. 3 is a view illustrating the effluent receiver mounted on the mask, the effluent receiver being in an unrolled state. This view also illustrates a holding device which can be used to hold the effluent receiver in a rolled state, and a one way valve, the holding device being disposed externally of the effluent receiver and the one way valve being disposed internally of the effluent receiver. This view further illustrates a closure device which is used to close the effluent receiver.

FIG. 4 is an exploded view of the assembly shown in FIG. 3, some parts being rotated for a better understanding of their nature.

FIG. 5 is a section taken generally along the line 5—5 in FIG. 4, the full line view illustrating the cross section of the effluent receiver when in a collapsed position and the broken line view illustrating the fully expanded position of the effluent receiver.

FIGS. 6 and 7 is a view illustrating a second form of effluent receiver which is provided with a differing form of closure device.

FIG. 8 is a view corresponding generally to FIG. 3 but illustrating another form of effluent receiver, which receiver is mounted on the face mask in a different manner.

DETAILED DESCRIPTION OF FIGS. 1-5

Figure 1:
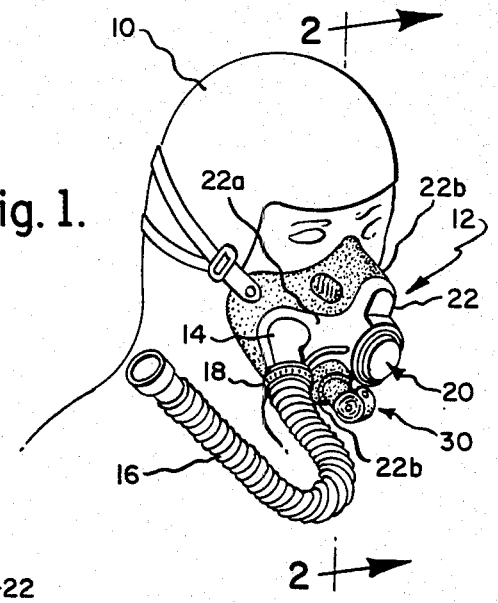
FIG. 1 is a perspective view of a breathing device as worn by an aviator, the device being provided with an effluent receiver which is illustrated in its stored or rolled-up position.
Figure 2:
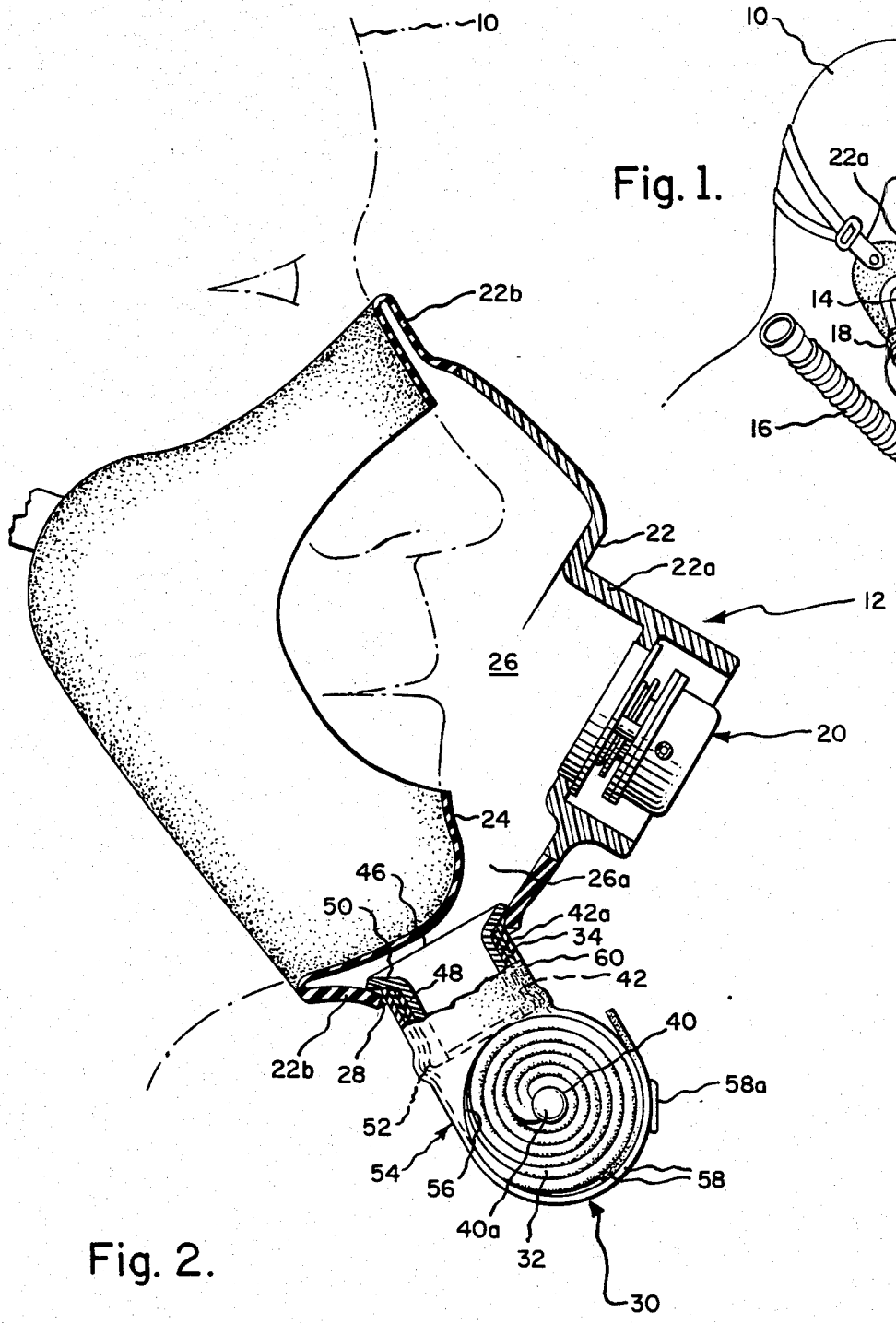
FIG. 2 is a side view taken generally along the line 2—2 of FIG. 1.

Referring first to FIG. 1, an aviator 10 is shown wearing a breathing device in the form of a mask indicated generally at 12. The mask is provided with an inlet to one side of the mask's medial plane, the inlet having a tubular portion 14 to which a flexible hose 16 is secured by means of a clamp 18. Breathing gases, which usually are oxygen, are introduced into the mask under pressure through the flexible hose 16 and tubular portion 14. The mask is further provided with an exhalation valve assembly indicated generally at 20, which exhalation valve may be of the type shown in U.S. Pat. No. 3,459,216. As can best be seen from FIG. 2, the mask has a face portion 22 and a sealing portion 24. When the mask is donned by an aviator, the face portion is spaced away from the face of the wearer to provide a breathing cavity 26 therein. The face portion 22 includes a rigid portion **22*a* and a peripheral resilient portion 22*b* which extends about the rigid portion. An inner annular edge of the resilient portion is bonded to the rigid portion 22*a* at one side and extends away from the rigid portion to its outer peripheral edge. The sealing portion 24 consists of a relatively thin resilient material which extends inwardly from the outer peripheral edge of the resilient face portion 22*b*, the relatively thin material contacting the face of the wearer, and specifically the bridge of the nose, chin, and cheeks. The resilient portion 22*b* in the vicinity of the chin is provided with an aperture 28 (FIG. 2). The structure so far described, with the exception of the aperture 28, is generally conventional. It should be appreciated from an inspection of FIG. 2 that effluents will collect in the lower portion 26*a* of the breathing cavity unless some means are provided to eliminate them from the mask. As such effluents would build up they could not only cause severe discomfort to the wearer, but also foul the exhalation valve indicated generally at 20. In accordance with the principles of this invention an effluent receiver or receptacle is associated with the aperture 28** in order to prevent such a buildup.

As can best be seen from FIG. 4 and 5, the effluent receiver is part of a receiver assembly indicated generally at 30. The receiver can be in the form of an elongated tubular member 32 formed of flexible material impervious to liquids, which member is collapsible as best indicated in FIG. 5. Thus, in the illustrated embodiment the tubular member 32 can be folded into a relatively flat form as indicated by the full lines in FIG. 5 but can be expanded when receiving effluents to the broken line position also illustrated in FIG. 5. One end 34 of the receiver 32 is generally cylindrical and the other end 36 is provided with an aperture which is normally closed by a removable closure device 40 which may include a transversely extending cylindrical portion **40*a* about which the effluent receiver may be rolled when in a flattened condition and a plug 40*b* which may be inserted into the aperture 38** to retain fluids within the effluent receiver.

In order to prevent material from within the effluent receiver from flowing back into the breathing cavity 26, valve means are provided. The valve means is of the one-way type and in the embodiment illustrated a "raspberry" valve 42 is utilized. As is well known to those skilled in the art a "raspberry" valve includes an elongated flexible member provided with an aperture extending throughout its length, one end of the valve **42*a* being formed in such a manner that in its free or mounted state the aperture is open, and the other end 42*b* being formed in such a manner that in its free or normal state it is flattened so that the aperture which extends through the other end is normally closed by the adjacent sidewalls of the flexible member. This construction permits air or fluid to flow in the direction indicated by the arrow 44 in FIG. 4 as the flattened end will open to permit the passage of air. However, if suction is applied to the end 42*a* the flattened end 42*b* will collapse further preventing the flow of air in a direction reverse to the arrow 44**.

Means are provided to secure the valve means 42 and the effluent receiver 32 to the face portion 22 of the mask, and preferably in the area of the chin where effluents will normally collect. To this end a relatively rigid tubular member indicated generally at 46 is provided. The tubular member 46 includes a generally cylindrical intermediate portion 48, a bell-shaped end 50, and an opposite end having a raised edge 52. In the embodiment illustrated both the effluent receiver 32 and the "raspberry" valve 42 are made of resilient material, and the cylindrical portion 48 of the tubular member 46 is of a diameter normally greater than the undistorted diameter of the cylindrical end 34 of the effluent receiver 32 and the end **42*a* of the "raspberry" valve 42, which parts are normally assembled on the cylindrical portion by stretching the end 42*a* and placing it about the cylindrical portion 48** in the manner best illustrated in FIG.

3 and then by doing the same with the end 34 of the effluent receiver 32.

In addition to the structure set forth above a holding device, indicated generally at 54 is provided, the purpose of the holding device being to hold the effluent receiver in a collapsed position after it has been rolled up about the cylindrical portion 40*a*, the collapsed position being best illustrated in FIG. 2 In the embodiment illustrated the holding device includes a resilient element formed initially of a resilient tube 60, slots 56 extending down the sides to form straps 58 to either side of the slots. The end of the straps are provided with conventional male and female fasteners 58*a*, 58*b*, respectively. The tubular end 60 can be disposed about the end 34 of the effluent receiver and end 42*a* of the "raspberry" valve. This end can be considered to be an intermediate portion 60 of the straps 58. If the valve 42 and the receiver 32 were not formed of resilient material, the tubular portion 60 alone could be used to hold the parts in their assembled position. Alternatively, a clamp similar to a radiator hose clamp could be utilized to hold the parts together. However, by making the parts of resilient material the effluent receiver can be easily removed for disposal, and, similarly, replacement parts can easily be assembled.

After the "raspberry" valve 42, effluent receiver 32, and holding device 54 have been assembled about the cylindrical portion 48 of the tubular member 44, the bell-shaped end 50 of the tubular member is then inserted through the aperture 28*a*. The bell-shaped end 50 will tend to maintain the parts in their assembled position with respect to the mask and any effluent which is received within the cavity 26*a* can then be received within the effluent receptacle 32 provided it is unrolled which can be done by releasing the snap fastener 58.

The modification of FIGS. 1–5, so far described, is suitable for use in a non-lethal atmosphere as it is possible for the "raspberry" valve 42 and/or tubular member 46 to be readily removed from the face portion of the breathing device. However, if it is contemplated that such a device is to be used in a lethal atmosphere it will be necessary to bond the bell-shaped end 50 of the tubular member 46 to the resilient portion 22*b* about the aperture 28. In addition, it will also be necessary to insure that the "raspberry" valve is secure about the cylindrical portion 48 of the tubular member 46. If the foregoing is done the breathing device will then be suitable for use in a lethal environment as the one-way or "raspberry" valve will prevent the ingress of noxious ambient gases into the breathing cavity. However, effluents can be readily disposed of by collecting such effluents in the effluents receiver 32, and then removing the receiver for subsequent disposition at which time a new receiver can be disposed about the "raspberry" valve. If the "raspberry" valve is not secure about the tubular member 46, it can be removed after use to facilitate cleanup. However, this design is not recommended for use in situations where lethal gases may be encountered.

DESCRIPTION OF FIGS. 6–7

Another form of effluent receiver is illustrated in FIGS. 6 and 7. The effluent receiver of this modification is indicated generally at 70 and consists of a plastic film bag, which may be formed of polyethylene, which plastic bag is provided with a cylindrical end portion 72 which may be clamped about the tubular extension or member 46. The other end of the receiver 70 is provided with another opening in the form of an extended open portion 74, which portion can be folded to an upper position as indicated in FIG. 7 about fold lines 74. When in the folded position the extended open portion will act as a closure device to seal the end of the receiver with which it is associated, and it can be held in a closed or sealing position by an adhesive tab 76. The receiver 70 can also be folded along the fold lines 77 and 78 prior to being rolled up wherein it can be held in a folded and rolled position. When in the folded and rolled position it would resemble the receiver 32 indicated in FIG. 2 and would not obstruct the vision of the user.

After either the receiver 32 or the receiver 70 has been used it can be disposed of without breaching the integrity of the breathing device.

DESCRIPTION OF FIG. 8

Referring now to FIG. 8 a further modification is illustrated. In this modification the resilient portion 22*b* is provided with an aperture defined by a cylindrical extension 80 in the vicinity of the chin which will, to a certain extent, replace the tubular member 46. One end of a "raspberry" valve 42, effluent receiver 82, and holding device 54 can be assembled about the cylindrical extension 80 in the manner indicated in the Figure. However, in order to prevent the cylindrical extension 80, which is formed from resilient or flexible material, from collapsing it is necessary to reinforce it by a small essentially rigid tubular insert 84.

While a different form of effluent receiver 82 is illustrated in FIG. 8, it should be noted initially that in the effluent receiver of the type illustrated at 32, or of the type illustrated at 70 in FIGS. 1 through 5, and 6 and 7, respectively could be utilized in this modification. However, the effluent receiver 82 is of the type which is an elongated tube normally open at one end. This form of effluent receiver could be used by ground troops and would permit the discharge of effluent away from the body, for example into an effluent receiver in a personnel carrier which would prevent the floor from becoming wet and slippery. While the effluent receiver 82 is illustrated in its extended position it can also be rolled up into a form of the type illustrated in FIG. 2 to prevent it from dangling and bothering the user and also from perhaps obstructing the vision of the user in certain situations. It should be noted that in the modification shown in FIG. 8 it is contemplated that the tubular insert will be bonded within the cylindrical extension 80, and that the "raspberry" valve 42 will be secured about the extension 80 to insure that noxious gases cannot reverse flow back into the breathing cavity at any time.

The complete operation of the foregoing devices should be obvious from the material set forth above.

By disposing the apertures 28 or 80 in the vicinity of the chin, or the lowest point of the breathing cavity, it is possible to collect and dispose of vomit, sweat, mucous, etc., as all effluents will naturally drain down.

While a preferred embodiment has been disclosed above, it is to be understood that this invention is not to be understood that this invention is not to be limited to the illustrated embodiment as various alternate embodiments will occur to those having ordinary skill in the art.

What is claimed is:

1. A breathing device comprising:

a face portion which is adapted to be spaced away from the face of a wearer of the breathing device to provide a breathing cavity within the interior of the face portion, said face portion being provided with inlet means for directing breathing gases into said breathing cavity, exhaust means for directing exhaust gases from said breathing cavity, said face portion further including an aperture therein adapted to be located adjacent the chin of the wearer sealing means interconnected with the face portion and capable of providing a seal to prevent the ingress of ambient gases into the breathing cavity of the egress of breathing gases from the breathing cavity other than through said inlet means, said exhaust means and said aperture, said sealing means being adapted to contact the bridge of the nose, cheeks, and chin of the wearer;

a disposable effluent receiver comprising a container having one end removably secured to the exterior of the face portion and fluidically connected to said aperture; and one-way valve means operatively mounted for permitting effluent material and/or gases to flow in one direction from the breathing cavity into the effluent receiver and for preventing the effluent material and/or gases within the receiver from flowing in the other direction into the breathing cavity.

2. The breathing device as set forth in claim 1 further characterized by the provision of a relatively rigid tubular member having a bell-shaped end and a generally cylindrical portion, said container having one end secured about said cylindrical portion, and said face portion having a resilient portion in the vicinity of the the chin of the wearer, said resilient portion being provided with said aperture in which said cylindrical portion is mounted, with said bell-shaped end being disposed within the breathing cavity and normally preventing the removal of the tubular member from said aperture.

3. The breathing device as set forth in claim 2 wherein said valve means includes one end secured about said cylindrical portion.

4. The breathing device as set forth in claim 1 wherein the container of said effluent receiver has a main body portion formed of a flexible plastic film.

5. The breathing device as set forth in claim 1 wherein the container of said effluent receiver has a main body portion formed of a flexible resilient material.

6. The breathing device as set forth in claim 1 wherein the container of said effluent receiver has a main body portion in the form of an elongated tube open at the other end.

7. The breathing device as set forth in claim 1 wherein a closure device is provided at the other end of the container of said effluent receiver.

8. The breathing device as set forth in claim 2 wherein said container is collapsible and further includes means for normally maintaining the container of the effluent receiver in a collapsed and rolled position.

9. The breathing device as set forth in claim 8 wherein said maintaining means is a resilient strap having an intermediate portion secured about said one end of the container and end portions adapted to surround said container in said collapsed and rolled position including fastening means securable to each other to hold the effluent receiver in said collapsed and rolled position.

10. The breathing device as set forth in claim 1 wherein said face portion is provided with a tubular extension, one end of the valve means being bonded about the tubular extension extending from said aperture, and one end of the effluent receiver being removably secured about said one end of the valve means.

11. The breathing device as set forth in claim 10 wherein the tubular extension is reinforced by a rigid tubular insert.

12. The breathing device as set forth in claim 1 wherein said one way valve means is a raspberry valve having a tubular end mounted adjacent said one end of the container of said effluent receiver.

* * * * *